US006928995B1

(12) United States Patent
Hrytzak

(10) Patent No.: US 6,928,995 B1
(45) Date of Patent: Aug. 16, 2005

(54) EMISSION CONTROL VALVE HAVING IMPROVED FORCE-BALANCE AND ANTI-COKING

(75) Inventor: Bernard J. Hrytzak, Chatham (CA)

(73) Assignee: Siemens VDO Automotive, Inc., Chatham (CA)

( * ) Notice: Subject to any disclaimer, the term of this patent is extended or adjusted under 35 U.S.C. 154(b) by 0 days.

(21) Appl. No.: 10/785,306

(22) Filed: Feb. 24, 2004

(51) Int. Cl.[7] ..... F02M 25/07
(52) U.S. Cl. ..... 123/568.2
(58) Field of Search ..... 123/569.11, 568.12, 123/568.18, 568.2, 568.21; 137/601.01, 861, 137/862

(56) References Cited

U.S. PATENT DOCUMENTS 4,350,013 A * 9/1982 Yoshiba ..... 123/568.2
6,006,732 A * 12/1999 Oleksiewicz ..... 123/568.2
6,047,690 A * 4/2000 Field et al. ..... 123/568.2
6,247,461 B1 * 6/2001 Smith et al. ..... 123/568.2
6,279,552 B1 * 8/2001 Okada et al. ..... 123/568.2
6,330,880 B1 * 12/2001 Okada et al. ..... 123/568.2

* cited by examiner

*Primary Examiner*—Willis R. Wolfe, Jr.

(57) ABSTRACT

A double-pintle valve (20) has two seats (54, 56) each circumscribing a respective through-hole for exhaust gas flow. The through-hole of one seat (56) is large enough diametrically to allow the closure (46) that seats on the other seat (54) to pass through during fabrication of the valve. The closure (46) seats substantially on a radially outermost portion of a frustoconical surface zone (54B) of the seat (54) and the other closure (48) seats substantially on a radially innermost portion of a frustoconical surface zone (56B) of the one seat (56) when the valve is disallowing flow.

12 Claims, 3 Drawing Sheets

EMISSION CONTROL VALVE HAVING IMPROVED FORCE-BALANCE AND ANTI-COKING

FIELD OF THE INVENTION

This invention relates generally to emission control valves that are used in emission control systems associated with internal combustion engines in automotive vehicles. The invention particularly relates to force-balance and anti-coking improvements in exhaust gas recirculation (EGR) valves.

BACKGROUND OF THE INVENTION

Controlled engine exhaust gas recirculation is a known technique for reducing oxides of nitrogen in products of combustion that are exhausted from an internal combustion engine to atmosphere. A typical EGR system comprises an EGR valve that is controlled in accordance with engine operating conditions to regulate the amount of engine exhaust gas that is recirculated to the fuel-air flow entering the engine for combustion so as to limit the combustion temperature and hence reduce the formation of oxides of nitrogen.

Because they are typically engine-mounted, EGR valves are subject to harsh operating environments that include wide temperature extremes and vibrations. Tailpipe emission requirements impose stringent demands on the control of such valves. An electric actuator, such as a solenoid that includes a sensor for signaling position feedback to indicate the extent to which the valve is open, can provide the necessary degree of control when properly controlled by the engine control system. An EGR valve that is operated by an electric actuator is often referred to as an EEGR valve.

When an engine with which an EEGR valve is used is a diesel engine, further considerations bear on the valve. Because such engines may generate significantly large pressure pulses, attainment of acceptable control may call for the use of a force-balanced EEGR valve so that any influence of exhaust gas pressure on valve control is minimized, and ideally completely avoided. For example, a large pressure pulse should not be allowed to force open an EEGR valve that is being operated to closed position by the solenoid.

A double-pintle type valve can endow an EEGR with a degree of force balance that is substantial enough to minimize the influence of exhaust gas pressure on valve control, for example minimizing the risk that large exhaust pressure pulses will open the EEGR valve when the engine control strategy is calling for the valve to be closed. A double-pintle type valve allows the valve to have a split-flow path where each pintle is associated with a respective valve seat. Such a valve can handle larger flow rates with a degree of control suitable for control of EGR.

Because of various factors that bear on an EEGR valve's ability to control tailpipe emissions for compliance with relevant regulations, including considerations already mentioned, construction details of a double-pintle EEGR valve become important. Individual parts must be sufficiently strong, tightly toleranced, thermally insensitive, and essentially immune to combustion products present in engine exhaust gases.

Certain combustion products in engine exhaust gases may tend to deposit on certain surfaces of certain parts of an EEGR valve. This phenomenon is sometimes called "coking", and it can be detrimental to valve performance.

For example, when an EEGR valve pintle is unseated from its seat to allow exhaust gas flow through an annular space between the outer perimeter of the pintle and the inner perimeter of the seat, surface zones of the perimeter margins of both pintle and seat become exposed to exhaust gas flow. Depending on the particular design of the pintle-seat interface, deposits may form on those zones. The nature of the deposited material may cause a pintle to stick to some extent on the seat when the pintle is closed, and that can interfere with proper valve operation. For example, when the valve is to re-open, sticking may require extra force to unseat the pintle, particularly when the valve is cold. The presence of such material can also interfere with proper pintle re-seating on the seat, possibly resulting in leakage through the valve when the pintle should seat fully closed on the seat.

Constructing one or the other of the pintle and the seat to have a sharp corner, 90° for example, rather than a flat angled surface that makes contact with a similarly angled surface of the other when the valve is closed, tends to resist the depositing of material at and near the corner. However, the degree of sharpness of such a corner may complicate the process of making the part containing the edge. For example, machining a seat to create circular edge having a sharp 90° corner that is intended to seat on a frustoconical surface of a pintle may require an operation, such as de-burring, to assure that no imperfections, such as burrs, are present in the edge. Such an edge may be prone to nicking, also undesirable.

In mass-production automotive vehicle applications, the cost-effectiveness of the construction of a component, such as an EEGR valve, is important, and so it is desirable to avoid extra processing operations in the manufacture of such a component whenever possible.

SUMMARY OF THE INVENTION

The present invention relates to certain improvements in the construction of an EEGR valve, such as a double-pintle EEGR valve, particularly improvements in the pintle-seat interfaces.

One improvement is directed to an interface that tends to discourage the deposit of materials from the exhaust gases passing through the valve on surfaces at the interface so that proper performance of an EEGR valve can continue during its useful life free of deposits at the interface that might otherwise seriously impair acceptable valve performance.

Another improvement is directed to better force-balancing of the pintle in a double-pintle EEGR valve for minimizing the influence of exhaust pressure fluctuations on valve operation. The conjunction of these improvements in an EEGR valve can contribute to better valve performance and longer useful life of an EEGR valve in an exhaust emission control system of a diesel engine, and with cost-effectiveness.

A general aspect of the invention relates to an emission control valve for use in an emission control system of an internal combustion engine. The valve comprises valve body structure providing an inlet port at which flow enters the valve and an outlet port at which flow exits the valve. A valve element comprises first and second closures spaced apart along an axis for respective cooperation with respective seats that are axially spaced apart to selectively seat on the respective seat for disallowing flow between the inlet port and the outlet port and to unseat from the respective seat for allowing flow between the inlet port and the outlet port. An actuator selectively positions the valve element along the axis relative to the seats.

Each seat circumscribes a respective through-hole for flow. The through-hole of one seat is large enough diametrically to allow the closure that seats on the other seat to pass through during fabrication of the valve. Each through-hole comprises a respective frustoconical surface zone coaxial with the axis and tapered in the same axial direction. The closure that seats on the other seat seats on a radially outermost portion of the frustoconical surface zone of the through-hole of the other seat when the valve element is disallowing flow, and the other closure seats on a radially innermost portion of the frustoconical surface zone of the through-hole of the one seat when the valve is disallowing flow.

Another general aspect relates to an exhaust gas recirculation system having such a valve.

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
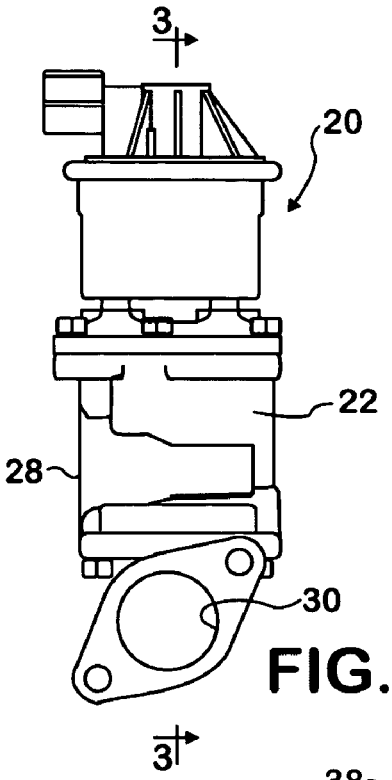
FIG. 1 is an elevation view of an EEGR valve embodying principles of the invention.
Figure 2:
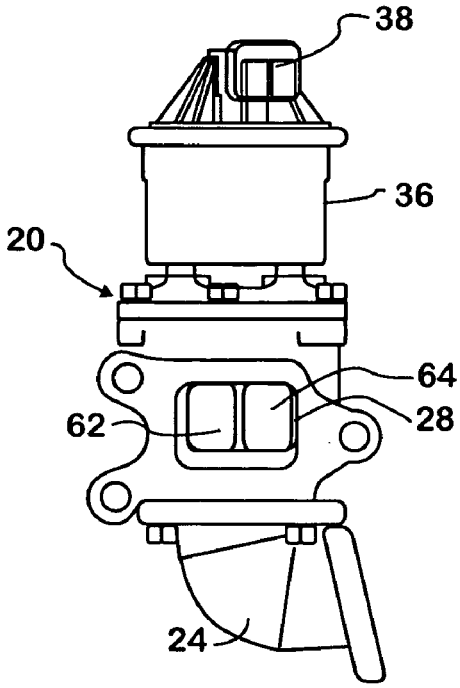
FIG. 2 is a left side elevation view of FIG. 1.
Figure 3:
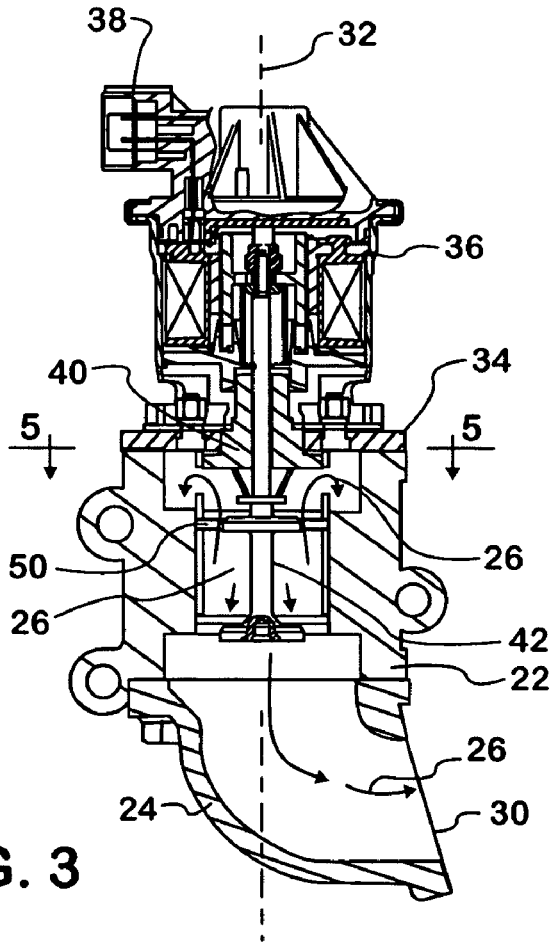
FIG. 3 is an enlarged cross section view in the direction of arrows 3—3 in FIG. 1.

FIGS. 1–3 illustrate the general arrangement and organization of an exemplary EEGR valve 20 embodying principles of the present invention. Valve 20 comprises a base 22 and an elbow 24 assembled together to form a flow path 26 through the valve between an inlet port 28 provided in a flange at a side of base 22 and an outlet port 30 provided in a flange at one end of elbow 24.

Base 22 is a metal part that has a main longitudinal axis 32. Base 22 may be considered to have a generally cylindrical shape about axis 32 comprising a generally cylindrical wall bounding an interior space that is open at opposite axial end faces of the base. Base 22 is constructed so that its interior space is also open to inlet port 28.

An end of elbow 24 that is opposite the end containing outlet port 30 is fastened in a sealed manner to the lower end face of base 22 so that the interior of elbow 24 is open to the interior space of base 22. A cover 34 is fastened in a sealed manner to the upper end face of base 22 to close that end of the interior space of base 22 while providing a platform for the mounting of an electric actuator 36 on the exterior of the cover.

Actuator 36 comprises a solenoid that, when the valve is installed on an engine in a motor vehicle, is electrically connected via an electric connector 38 (shown out of position in FIG. 3) to an electrical system of the motor vehicle to place the valve under the control of an engine controller in the vehicle.

Figure 4:
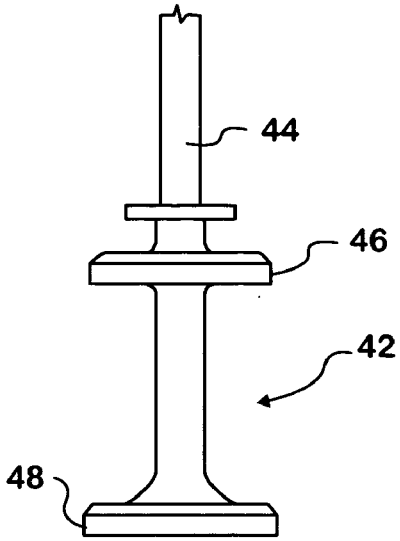
FIG. 4 is an elevation view of one part of the valve by itself, that part being a double-pintle.

A bearing 40 is centrally fit to cover 34 such that a guide bore of the bearing is coaxial with axis 32. Bearing 40 serves to axially guide a double-pintle 42 (shown by itself in FIG. 4) of valve 20 along axis 32 via a guiding fit of the bearing guide bore to an upper portion of a stem 44 of double-pintle 42 that extends completely through the bearing guide bore from an armature of the solenoid into the interior space of base 22 where upper and lower pintles 46, 48 are disposed on stem 44.

Figure 5:
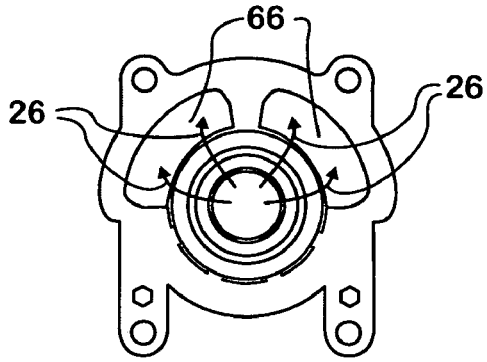
FIG. 5 is a cross section view in the direction of arrows 5—5 in FIG. 3.
Figure 6:
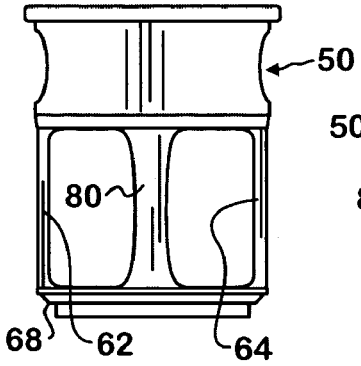
FIG. 6 is an elevation view of another part of the valve by itself, that part being a seat element having a double-seat.
Figure 7:
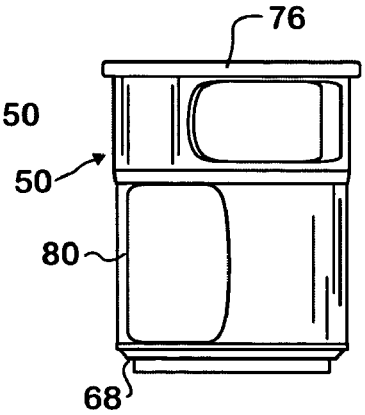
FIG. 7 is a right side elevation view of FIG. 6.
Figure 8:
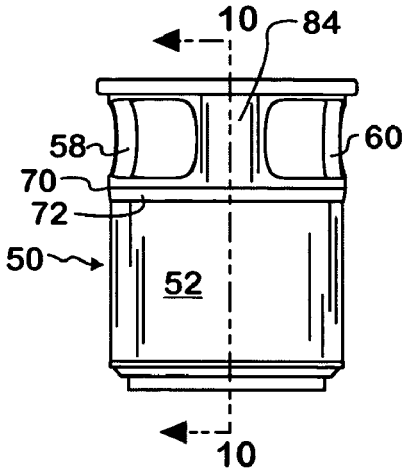
FIG. 8 is a rear elevation view of FIG. 6.
Figure 9:
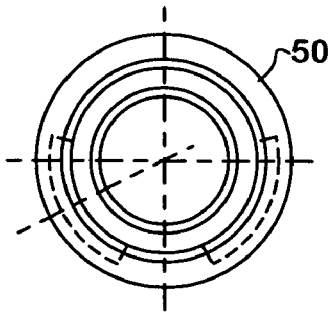
FIG. 9 is a top plan view of FIG. 8.

A double-seat element 50 shown by itself in FIGS. 6–9 is fit to base 22 within the latter's interior space. Element 50 is a machined metal part that has a generally cylindrical shape. It comprises a generally cylindrical wall 52 that is coaxial with axis 32 in valve 20 and that is open at opposite axial ends. Element 50 comprises axially spaced apart upper and lower seats 54, 56 (see FIG. 10) with which pintles 46, 48 respectively cooperate. Wall 52 comprises two pairs of openings, or apertures: an upper pair 58, 60, and a lower pair 62, 64. The lower pair are arranged axially between seats 54, 56 to provide for the open interior of element 50 that is circumscribed by wall 52 between seats 54, 56 to communicate through the opening in base 22 to inlet port 28. The upper pair 58, 60 are arranged axially beyond seat 54 relative to the lower pair 62, 64 to provide for the open interior of element 50 that is circumscribed by wall 52 beyond upper seat 54 to communicate with respective entrances to an internal passageway 66 (see FIG. 5) than runs within base 22 internally through a portion of the generally cylindrical wall of the base that is in the semi-circumferential portion of that wall opposite inlet port 28.

The outside diameter surface of wall 52 is stepped, comprising zones of successively larger diameter from bottom to top so as to allow element 50 to be assembled to base 22 by inserting element 50 into the interior space of base 22 through the opening in the upper end face of the base. The smallest outside diameter zone of wall 52 is at the bottom of element 50 essentially coextensive with seat 56. The next larger diameter zone is the one containing apertures 62, 64, and at the juncture of those two zones is a chamfered shoulder 68.

The next larger diameter zone is the one containing apertures 58, 60, and at its juncture with the zone containing apertures 62, 64, there is a raised circular ridge 70 having an inclined surface 72 that wedges with a portion of the inside diameter of the cylindrical wall of base 22 when element 50 is assembled to the base. The uppermost zone of wall 52 comprises a circular lip 76 on the outside and a shoulder on the inside.

When element 50 is assembled to base 22, the zone of wall 52 containing apertures 62, 64 fits to the circular inside diameter surface of the wall of base 22 in an orientation about axis 32 that places apertures 62, 64 in registration with inlet port 28, as shown in FIG. 2. Thereafter, a sub-assembly of cover 34, bearing 40, and actuator 36 are assembled to base 22 at the upper end face of the base by fastening the cover to the base. Before elbow 24 is placed on the lower face of base 22, double-pintle 42 is assembled into the valve through the open lower end face of the base. Stem 44 passes through the guide bore in bearing 40 and into the interior of the actuator where it attaches to the solenoid armature. With the solenoid not being energized, each of the two pintles 46, 48 seats on a respective seat, closing the respective opening, or through-hole, circumscribed by the respective seat. The armature is spring-biased to urge the pintles against the seats with an appropriate amount of force.

It can be appreciated that the outside diameter of upper pintle 46 is less than that of the through-hole circumscribed by lower seat 56 so that the former can pass through the latter during assembly of the double-pintle into the valve. Thereafter elbow 24 is fastened to base 22 to complete the assembly.

Valve is substantially force-balanced because of the particular double-pintle design. When inlet port 28 is communicated to the engine exhaust system so that hot engine exhaust gases can enter the valve, the pressure of those gases acting on the pintles creates forces that are substantially equal in magnitude, but in opposite directions along axis 32, although the upward force acting on pintle 48 will have a slightly larger magnitude than the downward one acting on pintle 46. Hence, pressure pulses will at most have a very minor, and ideally negligible, effect on the positioning of double-pintle 42 by actuator 36. This is important for control accuracy.

For the accurate handling of flow within a rather large range of flow rates, it is also important that the internal construction of the valve be substantially immune to the effects of exhaust gas constituents, exhaust gas temperature extremes, and exhaust gas pressure extremes. Parts that are important to control accuracy need strict manufacturing tolerances. Restriction of the flow path through the valve should be determined by the positioning of the valve element in relation to the valve seat, meaning that the design of other parts of the valve that define the flow path should impose a restriction that is essentially negligible when compared to the restriction between the valve element and the valve seat.

These objectives are best met by rigid metal parts that can be machined to the required dimensional accuracy. A double-pintle valve, as described, splits the entering exhaust gas flow so that the flow divides more or less equally as it passes through seat element 50. Ideally there should be essentially no restriction to the incoming flow entering the seat element from inlet port 28. For maximizing the cross sectional area through which the incoming flow enters seat element 50, the circumferential span of the opening in the wall of seat element 50 should be essentially its semi-circumference. Collectively, apertures 62, 64 do just that. But in order to minimize the wall thickness of the seat element while retaining the necessary degree of strength, rigidity, and dimensional accuracy of the seat element, the seat element is a machined part where the two apertures 62, 64 are separated by a narrow axial bar 80 in the wall, rather than being a single aperture having a like semi-circumferential span. Similarly, apertures 58, 60 are separated by a somewhat wider bar 84.

Figure 10:
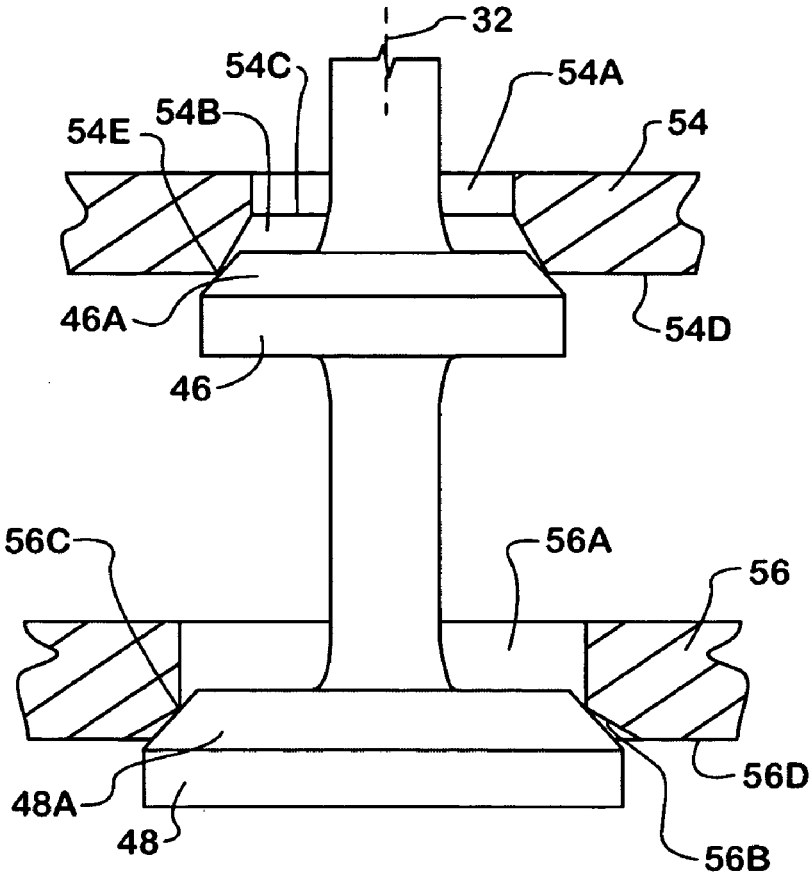
FIG. 10 is a cross section view in the direction of arrows 10—10 in FIG. 8, but including the pintle.

FIG. 10 shows the closed condition with each pintle 46, 48 seated on the respective seat 54, 56. Seat 54 circumscribes a circular through-hole defined by a circular cylindrical surface zone 54A both parallel and coaxial with axis 32 and a frustoconical surface zone 54B that extends from a circular edge 54C at its junction with zone 54A coaxial with axis 32 in the direction toward the space circumscribed by wall 52 between the two seats. The cone angle of zone 54B is 30° in this particular embodiment. Zone 54B ends at a flat surface zone 54D that is perpendicular to axis 32. The geometric relationship between zones 54B and 54D endows the seat with an obtuse-angled circular corner edge 54E against which a frustoconical surface 46A of pintle 46 seats when valve 20 is closed. Surface 46A has a cone angle of 42° in this particular embodiment.

Seat 56 circumscribes a circular through-hole defined by a circular cylindrical surface zone 56A both parallel and coaxial with axis 32 and a frustoconical surface zone 56B that extends from an obtuse-angled circular corner edge 56C at its junction with zone 56A coaxial with axis 32 in the direction away from the space circumscribed by wall 52 between the two seats. Zone 56B ends at a flat surface zone 56D that is perpendicular to axis 32. The cone angle of zone 56B is 60° in this particular embodiment. A frustoconical surface 48A of pintle 48 seats on corner edge 56C when valve 20 is closed. Surface 48A has a cone angle of 42° in this particular embodiment.

So that double-pintle 42 can be assembled into the valve, the diameter of zone 56A is made larger than the largest outside diameter of pintle 46, with an appropriate amount of radial clearance to facilitate assembly. The largest outside diameter of pintle 46 occurs in a circular cylindrical portion that extends axially from frustoconical surface 46A.

When each pintle is seated on the respective seat as shown in FIG. 10, the obtuse-angled corner edge 54E at the junction of seat surface zones 54B, 54*d* makes essentially circular line edge contact with surface 46A of pintle 46, and the obtuse-angled corner edge 56C at the junction of seat surface zones 56A, 56B makes essentially circular line edge contact with surface 48A of pintle 48.

With the smallest diameter portion of the through-hole in seat 56 contacting pintle 48 and the largest diameter portion of the through-hole in seat 54 contacting pintle 46, greatest correspondence between the effective areas of the two pintles on which exhaust gas pressure acts is attained, maximizing the extent of force-balance. The effective areas have respective diameters of 25.1 centimeters and 26.0 centimeters in this example.

At the same time, the geometries of the respective seat-pintle interfaces tend to discourage deposit of certain exhaust gas constituents at the interfaces. With the valve just slightly open, exhaust gas flowing through seat 54 is increasingly constricted between surfaces 54D, 46A as it approaches the point of maximum restriction at the obtuse-angled corner edge 54E, but once past that corner edge, the flow is allowed to expand as it passes between surfaces 54B, 46A.

The same is true at the other seat-pintle interface where the flow is increasingly constricted as it approaches corner edge 56C, and then once past corner edge 56C, it is allowed to expand due to the angular relationship between surfaces 48A, 56B.

Figure 11:
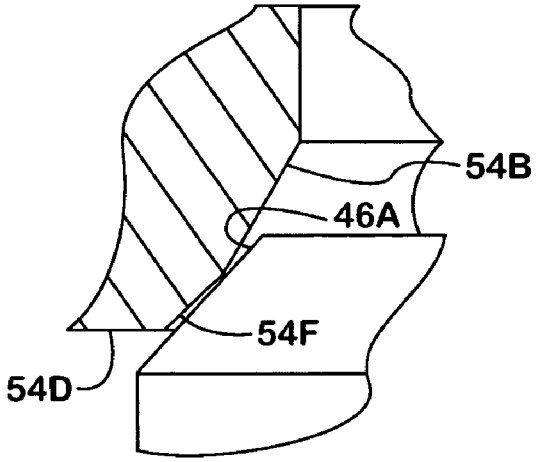
FIG. 11 is an enlarged fragmentary view of a portion of FIG. 10 showing a modification.
Figure 12:
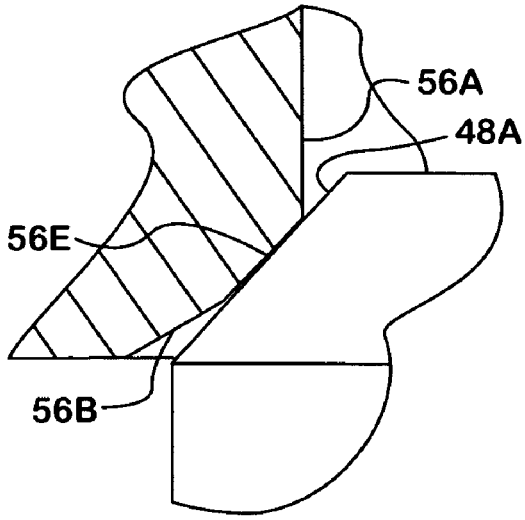
FIG. 12 is an enlarged fragmentary view of another portion of FIG. 10 showing a modification.

FIGS. 11 and 12 show respective modifications to seats 54 and 56 in another example. The drawings are exaggerated for clarity of illustration. Edge 54E has a slight chamfer 54F instead of being sharp. The cone angle of the chamfer is slightly larger (1° larger in the example) than the cone angle of surface 46A. Similarly, edge 56C has been modified to includes a slight chamfer 54E, whose cone angle is also 1° larger than the cone angle of surface 48A. It is believed that the inclusion of the chamfers can improve durability and performance.

Anti-coking features are embodied in the pintle-seat interfaces because of the geometries that have been described. A seat having an obtuse corner with a sharp edge or alternately a slightly chamfered one, as shown and described, makes substantial circular edge contact with a frustoconical surface zone of the corresponding pintle. When the valve is operated just slightly open, the flow is increasingly constricted as it approaches the corner edge. Once past the corner edge, the flow is allowed to expand due to the angular relationship between the seat and pintle surface zones.

While the foregoing has described a preferred embodiment of the present invention, it is to be appreciated that the inventive principles may be practiced in any form that falls within the scope of the following claims.

What is claimed is:

1. An emission control valve for use in an emission control system of an internal combustion engine comprising:

valve body structure providing an inlet port at which flow enters the valve, an outlet port at which flow exits the valve, a valve element comprising first and second closures spaced apart along an axis for respective cooperation with respective seats that are axially spaced apart to selectively seat on the respective seat for disallowing flow between the inlet port and the outlet port and to unseat from the respective seat for allowing flow between the inlet port and the outlet port, and an actuator for selectively positioning the valve element along the axis relative to the seats, wherein each seat circumscribes a respective through-hole for flow, the through-hole of one seat is large enough diametrically to allow the closure that seats on the other seat to pass through during fabrication of the valve, each through-hole comprises a respective frustoconical surface zone coaxial with the axis and tapered in the same axial direction, the closure that seats on the other seat seats substantially on a radially outermost portion of the frustoconical surface zone of the through-hole of the other seat when the valve element is disallowing flow, and the other closure seats substantially on a radially innermost portion of the frustoconical surface zone of the through-hole of the one seat when the valve is disallowing flow.

2. A valve as set forth in claim 1 wherein each frustoconical surface zone begins at an axial end of its through-hole.

3. A valve as set forth in claim 2 wherein each closure comprises a respective frustoconical surface zone having opposite axial ends, and an axially intermediate portion of the frustoconical surface zone of the respective closure seats on the through-hole of the respective seat.

4. A valve as set forth in claim 3 wherein the axially intermediate portion of the frustoconical surface zone of the respective closure seats substantially on an axial end of the frustoconical surface zone of the through-hole of the respective seat.

5. A valve as set forth in claim 4 wherein the axial end of the frustoconical surface zone of the through-hole of the respective seat on which the axially intermediate portion of the frustoconical surface zone of the respective closure substantially seats comprises a respective chamfer.

6. A valve as set forth in claim 5 wherein each respective chamfer has a cone angle slightly larger than the cone angle of the frustoconical surface zone of the respective closure.

7. An internal combustion engine comprising an exhaust gas recirculation system for recirculating some engine exhaust gas through the engine via an exhaust gas recirculation valve external to engine combustion chambers wherein the valve comprises valve body structure providing an inlet port at which exhaust enters the valve, an outlet port at which exhaust exits the valve, a valve element cooperating with a seat element for selectively restricting flow between the inlet port and the outlet port by selectively restricting flow through the seat element, an actuator for selectively positioning the valve element along an axis relative to the seat element, wherein the seat element comprises first and second valve seats axially spaced apart and the valve element comprises first and second closures axially spaced apart, each closure arranged to seat on the respective seat for closing flow between the inlet port and the outlet port and to unseat from the respective seat for allowing flow between the inlet port and the outlet port, and wherein each seat circumscribes a respective through-hole for flow, the through-hole of one seat is large enough diametrically to allow the closure that seats on the other seat to pass through during fabrication of the valve, each through-hole comprises a respective frustoconical surface zone coaxial with the axis and tapered in the same axial direction, the closure that seats on the other seat seats substantially on a radially outermost portion of the frustoconical surface zone of the through-hole of the other seat when the valve element is disallowing flow, and the other closure seats substantially on a radially innermost portion of the frustoconical surface zone of the through-hole of the one seat when the valve is disallowing flow.

8. An engine as set forth in claim 7 wherein each frustoconical surface zone begins at an axial end of its through-hole.

9. An engine as set forth in claim 8 wherein each closure comprises a respective frustoconical surface zone having opposite axial ends, and an axially intermediate portion of the frustoconical surface zone of the respective closure seats on the through-hole of the respective seat.

10. An engine as set forth in claim 9 wherein the axially intermediate portion of the frustoconical surface zone of the respective closure seats substantially on an axial end of the frustoconical surface zone of the through-hole of the respective seat.

11. An engine as set forth in claim 10 wherein the axial end of the frustoconical surface zone of the through-hole of the respective seat on which the axially intermediate portion of the frustoconical surface zone of the respective closure substantially seats comprises a respective chamfer.

12. An engine as set forth in claim 11 wherein each respective chamfer has a cone angle slightly larger than the cone angle of the frustoconical surface zone of the respective closure.

* * * * *